United States Patent [19]

Izzi, Sr.

[11] Patent Number: 4,482,161

[45] Date of Patent: Nov. 13, 1984

[54] TOILET BOWL GASKET OF RUBBERLIKE MATERIAL HAVING COMPRESSIBLE CONCENTRIC RIDGE RINGS ON BOTH SIDES

[75] Inventor: Lewis B. Izzi, Sr., Shelby, N.C.

[73] Assignee: Plastic Oddities, Inc., Shelby, N.C.

[21] Appl. No.: 555,638

[22] Filed: Nov. 28, 1983

Related U.S. Application Data

[63] Continuation-in-part of Ser. No. 370,187, Apr. 21, 1982, Pat. No. 4,423,526.

[51] Int. Cl.[3] ..... F16J 15/10

[52] U.S. Cl. ..... 277/207 A; 277/212 F; 285/59; 4/252 R

[58] Field of Search ..... 4/252 R; 277/207 R, 277/212 R, 212 F, 207 A, 207 B; 285/56–60

[56] References Cited

U.S. PATENT DOCUMENTS

| | | | |
|---|---|---|---|
| 612,394 | 10/1898 | Bernardi | 277/207 |
| 879,176 | 2/1908 | Jackson | 285/59 |
| 1,273,738 | 7/1918 | Christenson | 277/207 X |
| 1,333,368 | 3/1920 | Auer | 285/59 |
| 1,679,779 | 8/1928 | Oberhuber | 277/207 X |
| 3,228,039 | 1/1966 | Freeman | 277/207 X |
| 3,501,172 | 3/1970 | Pickard | 285/59 |
| 3,642,294 | 2/1972 | Hammon | 277/207 |
| 4,059,289 | 11/1977 | Morris et al. | 285/56 |
| 4,127,278 | 11/1978 | Henniges | 277/207 |
| 4,184,702 | 1/1980 | Morris | 285/59 X |

*Primary Examiner*—Robert S. Ward

*Attorney, Agent, or Firm*—Laurence R. Brown

[57] ABSTRACT

A ringlike shaped resuable gasket of rubberlike material such as polyvinyl chloride capable of returning to its original shape for sealing the joint between a drainage pipe and a toilet bowl seals the toilet bowl horn at a central aperture sealing portion shaped to flexibly engage the horn to replace conventionally used wax sealing rings and the like. It may be installed in hot or cold weather conditions and resued when the toilet bowl is removed and replaced. A thin web portion integrally extending from the central sealing portion mates between the mounting flange surface and toilet bowl to supplement the central sealing surface, and preferably has offset tapered concentric ridges on both sides. A downwardly extending outer rim engages the flange for holding in place frictionally. Mating bolt apertures smaller than the bolts hold the bolts in place fully extended for mounting the toilet bowl.

9 Claims, 4 Drawing Figures

FIG. 1
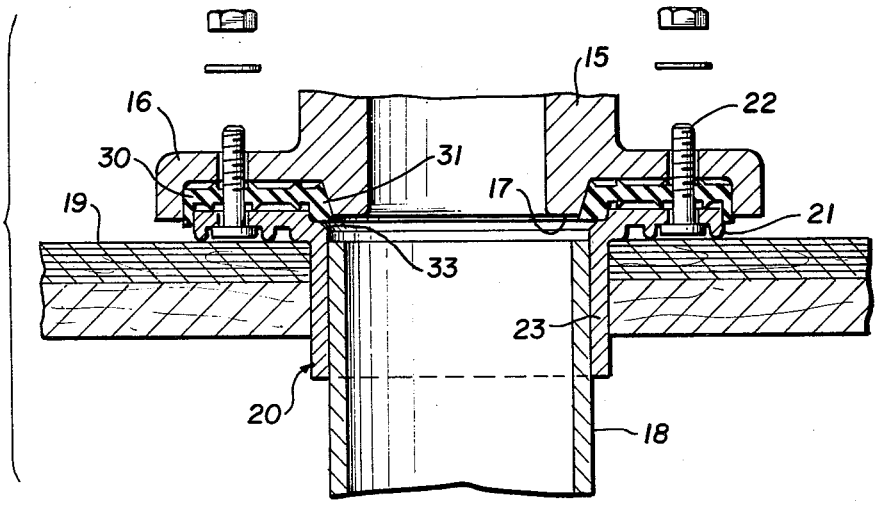
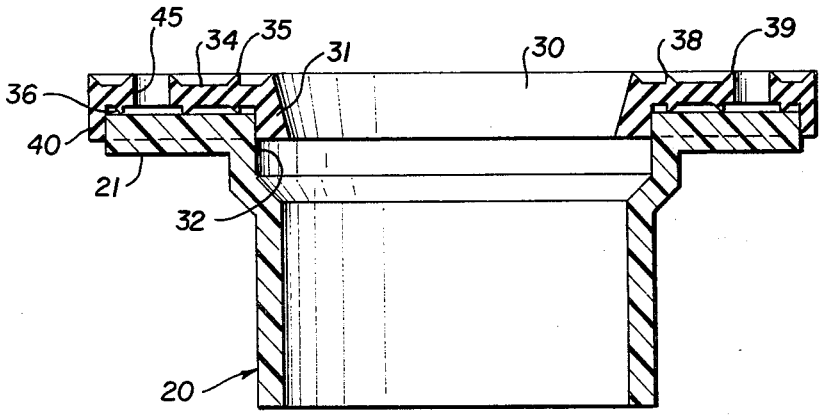
FIG. 2

TOILET BOWL GASKET OF RUBBERLIKE MATERIAL HAVING COMPRESSIBLE CONCENTRIC RIDGE RINGS ON BOTH SIDES

This is a continuation-in-part of my copending application Ser. No. 370,187 filed Apr. 21, 1982, U.S. Pat. No. 4,423,526.

TECHNICAL FIELD

This invention relates to plumbing fittings and more particularly it relates to fitting toilet bowls to drainpipes in a leakproof sealing arrangement.

BACKGROUND ART

The conventional manner of sealing toilet bowls to drainpipes mounted by bolting to a floor mounted flange is to insert a centrally placed wax ring seal on a central aperture of the flange and to deform it by bolting down the toilet bowl horn tightly thereinto. When the toilet bowl is rocked, however, such as by bolts loosening in ordinary use, the seal will be broken and gases will leak out. Also water from the toilet bowl can leak out onto the floor surface. The wax ring must be heated for winter installation and can melt in hot summer weather. It is not strong and will tend to "blow out" with a low pressure. Wax rings cannot be reused because they become disfigured when the toilet bowl is removed and cannot retain the sealing engagement when reinstalled.

If a toilet bowl is installed on an uneven floor, it may tend to rock when used, or to require such tightening of installation bolts that the bowl may crack. Whenever a toilet bowl rocks in a wax seal the seal may be broken and permit gas to escape.

Other problems exist in the installation process. Because a wax seal is thick, the installation bolts, generally extending through a mounting flange are not accessible easily so that bolt pressure can be used to force the toilet bowl into a firmly seated position. Also the ceramic bowl will break if excessive pressure is encountered such as a cold, hard wax seal at low temperatures. Thus, installation is tedious, costly and time consuming.

It is therefore an objective of this invention to provide improved gasket seals for mounting toilet bowls which seal better at far greater gas pressure, which make installation easier and which can be reused if the toilet bowl is removed and reinstalled.

Also, it is an objective of this invention to provide a seal that will not be broken if the toilet bowl is rocked in place.

Other objects, features and advantages of the invention will be suggested to those skilled in the art throughout the following description, claims and drawing.

DISCLOSURE OF THE INVENTION

This invention provides for a reusable thin flexible ringlike gasket of rubberlike material such as polyvinyl chloride that rests between a flange coupling a toilet bowl to the drainpipe and the toilet bowl to prevent both water and gas leakage at the bowl to drainpipe joint. The gasket has a memory for returning it to its original shape after flexing thereby permitting reuse after removing a toilet bowl and keeping the toilet bowl in a sealed coupling joint even when the bowl rocks in place, or the like.

The gasket frictionally grips the flange resting on the floor surface that extends to join the terminal end of the drainpipe under the floor. Thus, it has a downwardly extending central opening sealing portion shaped to engage both the toilet bowl horn and the flange central aperture in sealing engagement that flexes the rubberlike material. Also, it has a perpendicularly extending thin ringlike web portion interposed between the flange and the toilet bowl base that terminates in a downwardly extending rim that mates frictionally over the flange to hold the gasket in place. Concentrically positioned staggered ridges, preferably tapered from the web upwardly, positioned on both sides of the web portion further provide compressible sealing engagement structure between the toilet base and flange.

Bolt hole openings mating with toilet mounting bolts between the toilet base and flange base holes smaller than bolts to thereby grip and hold the bolts fully extended upwardly through the flange for seating the toilet bowl thereupon without dislodging the bolts down into the flange so that they are unaccessible from the topside.

BRIEF DESCRIPTION OF THE DRAWINGS

In the drawings:

FIG. 1 is an elevation broken away partial section view through the floor surface of a joint between a toilet bowl and a drainpipe embodying this invention;

FIG. 2 is an elevation section view of a typical plastic toilet bowl mounting flange having the toilet bowl sealing gasket afforded by this invention fit thereon.

THE PREFERRED EMBODIMENT

Figure 3:
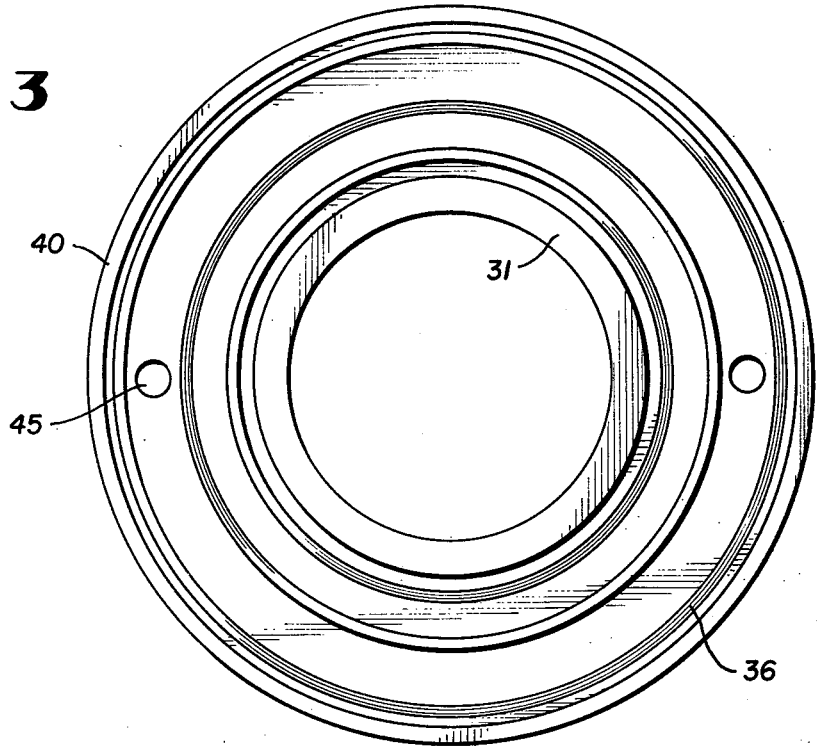
FIGS. 3 and 4 are respective bottom and top plan views of the sealing gasket afforded by this invention.

In FIG. 1, a toilet bowl assembly 15 has a base 16 and horn 17 for attachment to drainpipe 18 terminating under or level with the surface of the floor 19 upon which the toilet bowl is mounted. A mounting flange unit 20 of various configurations and made of plastic and/or metal fixes the drainpipe 18 firmly to the floor and by means of the flange 21 secures the toilet bowl assembly 15 in place on the floor. The particular flange unit 20 shown in this figure is of the flush fit type that permits coupling of a drainpipe 18 cut off flush with the floor surface 19. When both the drainpipe and the flange are of plastic, the units are solvent welded together to form a seal with the drainpipe 18 either inside or outside the cylindrical barrel 23 of the flange unit 20.

It has been customary at the present state of this art in practice to provide a wax ring seal force fit and crushed between the toilet bowl base 16 and horn 17 and the mounting flange 21 to seal the joint from escape of sewer gas that might be in the drainpipe 18. However, this invention provides an integral gasket ring 30 of rubberlike elastic material, preferably polyvinyl chloride, that has a memory so that it returns to its original shape after flexing to receive a toilet bowl in place, thereby being reliably reusable when the toilet bowl is removed and replaced, or becomes loose and rocks in a manner that could break a wax seal and cause it to leak.

Figure 4:
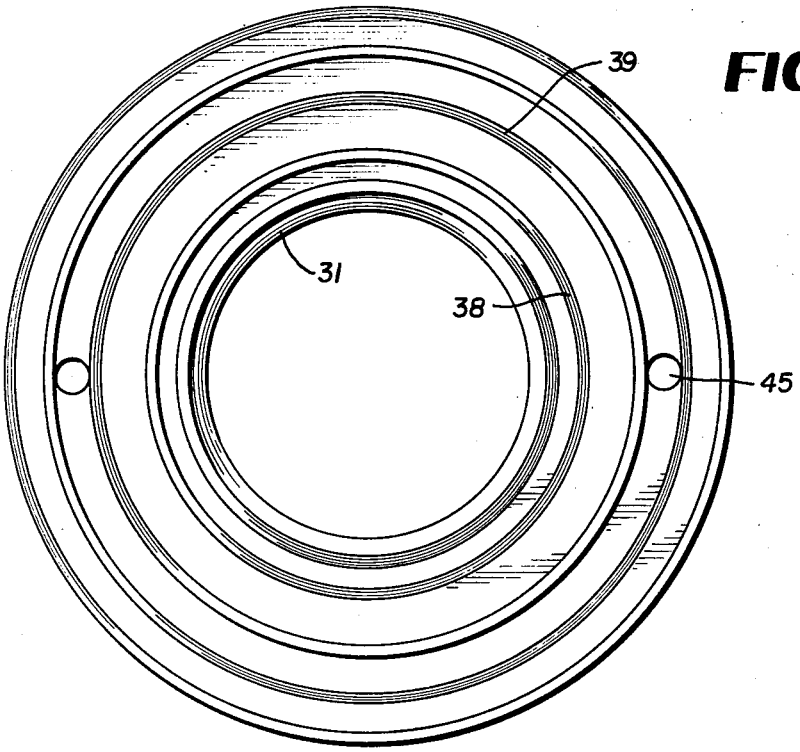

As may be seen more clearly in the views of FIGS. 2 to 4, there are a number of significantly advantageous features in the illustrated gasket 30 construction. The basic gasket ring has a central flange aperture sealing ring portion 31 shaped to flexibly seat in compression between and against respectively the toilet bowl horn 17 and the flange assembly 20 within its central aperture portion 32. As may be seen the central sealing ring 31 of the gasket 30 will engage the sloped surface 33 inside the central aperture of the flange assembly embodiment 20 shown in FIG. 1 and also the cylindrical surface 32 of the flange assembly embodiment of FIG. 2. Thus, the gasket ring sealing feature will cooperatively seal the joint for a wide range of the currently available mounting flange structures.

Extending laterally and perpendicularly from the central sealing ring portion 31 of the gasket is a thin sheet-like web portion 34 to provide supplemental sealing action by engagement between the flange 21 and the toilet bowl base 16. Because of irregularities in manufacturing tolerances of the generally ceramic toilet bowls, the flange to toilet bowl fit is not always uniform. Thus, at least one concentric raised ridge on both the upper side 35 and the lower side 36 is provided for engaging respectively the toilet bowl base 16 and the flange 21 providing a liquid and gas tight sealing joint. This joint supplements the central sealing ring 31 and for example can prevent the escape of water from the toilet and drainpipe or gas even under considerable pressure, as will later be set forth in more detail.

The upper concentric ridges 35 and the lower concentric ridges 36 are staggered or offset as seen from FIGS. 2, 3 and 4. Preferably the ridge structure is tapered from the web surface outwardly, and comprise substantially right triangular form disposed with one perpendicular side 38 extending away from the web surface. To provide higher pressure sealing capability the tapers or perpendicular sides on each of at least two ridges and the upper and lower surfaces face both inwardly toward the central aperture and outwardly as illustrated by 38, 39 for example.

An outer rim 40 formed concentrically about the web ring 34 extends downward in installed position to frictionally engage and mate with the outer circumference of the flange 21. This holds the gasket sealing member firmly in place seated to receive the horn of the toilet into the central aperture sealing ring 31. The sealing ring 31 has its inner circumferential surface tapered inwardly from the web to the central aperture on the upwardly disposed surface for receiving the toilet horn when installed. The outer circumferential surface of the sealing ring portion 31 is generally cylindrical in shape.

Two gasket holes 45 diametrically opposed on opposite sides of the web sheet 34 to mate with mounting bolts 22 have a diameter less than that of the bolts thereby to frictionally and resiliently engage and grip the bolts in their fully extended upwardly directed position as shown in FIG. 1 for receiving the toilet bowl assembly 15 and base 16 thereover. This avoids the problems of losing the bolts 22 during installation and having to fish them out and reposition them or to remove the toilet bowl and replace them.

The web 34 thickness of a typical polyvinyl chloride sealing gasket is typically one-eighth inch (0.32 cm) thick with one-sixteenth inch (0.16 cm) ridge ehgiths. A typical thickness of the widest part of the inner sealing ring 31 is three-eights of an inch (0.48 cm). Overall gasket dimensions are typically 5¼ inch (13.3 cm) outer diameter and 3¼ inch (8.25 cm) inner diameter. A preferred durometer hardness is 60 (Shore A±5); tensile strength is 1200 pounds; elongation 340; tear resistance is 340 pounds; specific gravity 1.16.

It is found in pressure tests of the gasket embodiment afforded by this invention that unexpectedly superior performance in the presence of pressure is afforded as compared with wax ring seals. The wax ring seals leaked at 8 p.s.i. pressure with holding times of less than one minute, whereas the seal afforded by this invention withstood up to 32 p.s.i. pressure without any leakage.

Therefore, the art is advanced by this invention and those novel features believed descriptive of the nature and spirit of the invention are defined with particularity in the claims.

I claim:

1. A gasket for sealing the joint between a drainage pipe and a toilet bowl in a coupling of the type wherein the horn of a toilet bowl positioned on a floor surface by bolting its base to a mounting flange fitting connected with a drainpipe terminating at or below the floor surface to prevent leakage of gas or fluids through the coupling joint, comprising in combination, an integral gasket ring of rubberlike elastic material having a memory so that it returns to its original shape after flexing presenting a central aperture sealing portion shaped to flexibly seat against the horn of said toilet bowl with a thin sheet-like ring web portion extending laterally therefrom for fitting between the mounting flange and the toilet bowl defining integrally thereon at least two concentric raised ridges staggered on each side of the web along the web and tapered from the web portion outwardly to form wedges of substantially right triangular form for providing a liquid and gas retaining sealing joint supplementing the central aperture seal against the horn and an outer rim formed concentrically about the central aperture which extends downward in installed position to mate with the outer circumference of said flange and hold the gasket frictionally in place seated to receive the horn of the toilet into the central aperture sealing portion.

2. A gasket as defined in claim 1 wherein two diametrically opposed bolt holes smaller than the bolt are formed by said web portion for mating over bolts mounting the toilet bowl and flange thereby to form a frictional grip for holding the bolts in place in the flange fully extended to pass through mating apertures in the base of the toilet for receiving threaded nuts.

3. A gasket as defined in claim 1 wherein the two concentric ridges on each side of the web have their tapered wedges of substantially right triangular form disposed with one perpendicular side extending away from the web facing respectively inwardly toward the central aperture and another perpendicular side facing outwardly.

4. A gasket as defined in claim 1 wherein the central aperture sealing portion extends substantially perpendicular from the web on the lower surface as installed and is shaped to flexibly seat in compression between and against respectively the toilet bowl horn and the flange fitting.

5. A gasket as defined in claim 1 made of polyvinyl chloride material.

6. A gasket as defined in claim 5 made with a web thickness of about one-eighth inch (0.32 cm).

7. A gasket as defined in claim 1 with a durometer hardness of about 60.

8. A gasket for sealing the joint between a drainage pipe and a toilet bowl in a coupling of the type wherein the horn of a toilet bowl positioned on a floor surface by bolting its base to a mounting flange fitting connected with a drainpipe terminating at or below the floor surface to prevent leakage of gas or fluids through the coupling joint, comprising in combination, an integral gasket ring of rubberlike elastic material having a memory so that it returns to its original shape after flexing presenting a central aperture sealing portion shaped to flexibly seat against the horn of said toilet bowl with a thin sheet-like ring web portion extending laterally therefrom for fitting between the mounting flange and the toilet bowl defining integrally thereon at least one concentric raised ridge for providing a liquid and gas retaining sealing joint supplementing the central aperture seal against the horn wherein the concentric ridge is tapered from the web portion surface outwardly and wherein at least two concentric ridges on each side of the web have tapered wedges of substantially right triangular form disposed with one perpendicular side extending away from the web facing respectively inwardly toward the central aperture and outwardly.

9. A gasket as defined in claim 8 with the concentric ridges on the two sides of the web staggered in position along the web.

* * * * *